US009915407B2

(12) United States Patent
Shibata et al.

(10) Patent No.: US 9,915,407 B2
(45) Date of Patent: Mar. 13, 2018

(54) VEHICULAR LAMP

(71) Applicant: Koito Manufacturing Co., Ltd., Tokyo (JP)

(72) Inventors: Hiroki Shibata, Shizuoka (JP); Akira Saijo, Shizuoka (JP); Hiromichi Akimoto, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 0 days.

(21) Appl. No.: 15/270,171

(22) Filed: Sep. 20, 2016

(65) Prior Publication Data

US 2017/0097137 A1 Apr. 6, 2017

(30) Foreign Application Priority Data

Oct. 2, 2015 (JP) ..... 2015-196544

(51) Int. Cl.
*F21V 1/00* (2006.01)
*F21S 8/10* (2006.01)

(52) U.S. Cl.
CPC ..... *F21S 48/328* (2013.01); *F21S 48/115* (2013.01)

(58) Field of Classification Search
CPC ..... F21S 48/328; F21S 48/115
USPC ..... 362/509, 459, 547, 549
See application file for complete search history.

(56) References Cited

U.S. PATENT DOCUMENTS

2012/0294024 A1* 11/2012 Peck ..... F21S 48/1159 362/516
2014/0160773 A1* 6/2014 Peters ..... F21S 48/1109 362/382
2014/0369062 A1* 12/2014 DiPenti ..... F21S 48/1104 362/545
2015/0252973 A1* 9/2015 Muller ..... F21S 48/1109 362/516
2016/0033103 A1* 2/2016 Nakano ..... B60Q 11/005 362/487
2016/0061402 A1* 3/2016 Kanayama ..... F21S 48/1747 362/521

FOREIGN PATENT DOCUMENTS

JP 2014-007106 A 1/2014

* cited by examiner

*Primary Examiner* — Elmito Breval
*Assistant Examiner* — Glenn Zimmerman
(74) *Attorney, Agent, or Firm* — Abelman, Frayne & Schwab

(57) ABSTRACT

Disclosed is a vehicular lamp including: a lamp outer case including a lamp housing having an opening and a cover configured to close the opening; a first board mounted with a first light source package; a second board mounted with a second light source package; and an optical member mounted with the first board and the second board. The first board and the second board are different kinds of boards that have different heat dissipation performances. Since the heat dissipation property for the heat generated when the first light source package is driven and the heat dissipation property of the heat generated when the second light source package is driven becomes different from each other, the heat dissipation performances may be properly controlled depending on an irradiation state.

8 Claims, 7 Drawing Sheets

VEHICULAR LAMP

CROSS-REFERENCE TO RELATED APPLICATIONS

This application is based on and claims priority from Japanese Patent Application No. 2015-196544, filed on Oct. 2, 2015, with the Japan Patent Office, the disclosure of which is incorporated herein in its entirety by reference.

TECHNICAL FIELD

The present disclosure relates to a vehicular lamp having two boards, on each of which a light source package emitting light is mounted.

BACKGROUND

A vehicular lamp such as, for example, a vehicle headlamp includes a plurality of light sources, and a semiconductor light emitting element such as, for example, a light emitting diode, is used as each of the light sources (see, e.g., Japanese Patent Laid-Open Publication No. 2014-007106). The semiconductor light emitting element is mounted on a board, and turned on by being supplied with power.

In the vehicular lamp disclosed in Japanese Patent Laid-Open Publication No. 2014-007106, the plurality of light sources are arranged to be space apart from each other in a left-right direction. The vehicular lamp is configured such that, when predetermined ones of the light sources are turned on, a low beam is irradiated, and when all the light sources are turned on, a high beam is irradiated.

SUMMARY

In the above-described vehicular lamp, it is required to ensure an irradiation state of luminous intensity above a certain level or more in order to improve, for example, safety. However, when a current value applied to a semiconductor light emitting element is raised in order to increase the luminous intensity, the temperature of the light emitting element is raised at the time of driving, and thus, it may be impossible to secure a stable lighting state of the semiconductor light emitting element. Thus, it is required to improve the heat dissipation performance of the semiconductor light emitting element.

Meanwhile, in the above-described vehicular lamp having the plurality of light sources, it is desirable that a plurality of irradiation states such as, for example, a low beam and a high beam are able to be set by a lighting ON/OFF control for the light sources, and thus, a heat dissipation control is performed depending on the irradiation state.

The present disclosure is to provide a vehicular lamp that is capable of overcoming the above-described problems, and performing a heat dissipation control depending on an irradiation state.

First, a vehicular lamp according to the present disclosure includes: a lamp outer case including a lamp housing including an opening and a cover configured to close the opening; a first board mounted with a first light source package; a second board mounted with a second light source package; and an optical member mounted with the first board and the second board. The first board and the second board are different kinds of boards that have different heat dissipation performances.

Accordingly, the heat dissipation performance for the heat generated when the first light source package is driven and the heat dissipation performance for the heat generated when the second light source package is driven become different from each other.

Second, in the above-described vehicular lamp according to the present disclosure, the first light source package may be turned on by an electric power higher than that required for turning on the second light source package, and the first board may have a heat dissipation performance higher than that of the second board.

Accordingly, the heat dissipation performance for the heat generated when the first light source package is driven becomes higher than the heat dissipation performance for the heat generated when the second light source package is driven.

Third, in the above-described vehicular lamp according to the present disclosure, the first board may be a metallic board, and the second board may be a resin board.

Accordingly, in a simple configuration, the heat dissipation performance for the heat generated when the first light source package is driven becomes higher than the heat dissipation performance for the heat generated when the second light source package is driven.

Fourth, in the above-described vehicular lamp according to the present disclosure, the vehicular lamp may further include a heat sink configured to release heat conducted from the first board.

Accordingly, the heat generated when the first light source package is driven is released by the heat sink.

Fifth, in the above-described vehicular lamp according to the present disclosure, two second light source packages may be arranged to be spaced apart from each other in a left-right direction, and the first light source package may be configured to be used for a low beam.

Accordingly, the first light source package for the low beam whose use frequency is high used is turned on by a high electric power.

Sixth, in the above-described vehicular lamp according to the present disclosure, the first board may have a heat dissipation performance higher than that of the second board, two second light source packages may be arranged to be spaced apart from each other in a left-right direction, and the first light source package may be used for a high beam.

Accordingly, the first board mounted with the first light source package for the high beam has a heat dissipation performance higher than that of the second board.

Seventh, in the above-described vehicular lamp according to the present disclosure, the first light source package may be provided with two semiconductor light emitting elements, and the second light source package may be provided with one semiconductor light emitting element.

Accordingly, the luminous flux in the first light source package is increased.

Eighth, in the above-described vehicular lamp according to the present disclosure, the heat sink may be mounted on the second board, and the first board may be mounted on the heat sink.

Accordingly, the first board is mounted on the second board via the heat sink.

Ninth, in the above-described vehicular lamp according to the present disclosure, the second board and the heat sink may be mounted on the optical member by co-fastening.

Accordingly, it is not necessary to separately mount the second board and the heat sink on different members.

Tenth, in the vehicular lamp according to the present disclosure, the second board may be formed with an alignment opening, and the first board may be arranged in the alignment opening.

Accordingly, the first board is arranged inside the second board.

According to the present disclosure, since the heat dissipation property for the heat generated when the first light source package is driven and the heat dissipation property for the heat generated when the second light source package is driven become different from each other, a good heat dissipation performance control may be performed depending on an irradiation state.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

In the following detailed description, reference is made to the accompanying drawing, which form a part hereof. The illustrative embodiments described in the detailed description, drawing, and claims are not meant to be limiting. Other embodiments may be utilized, and other changes may be made, without departing from the spirit or scope of the subject matter presented here.

Figure 1:
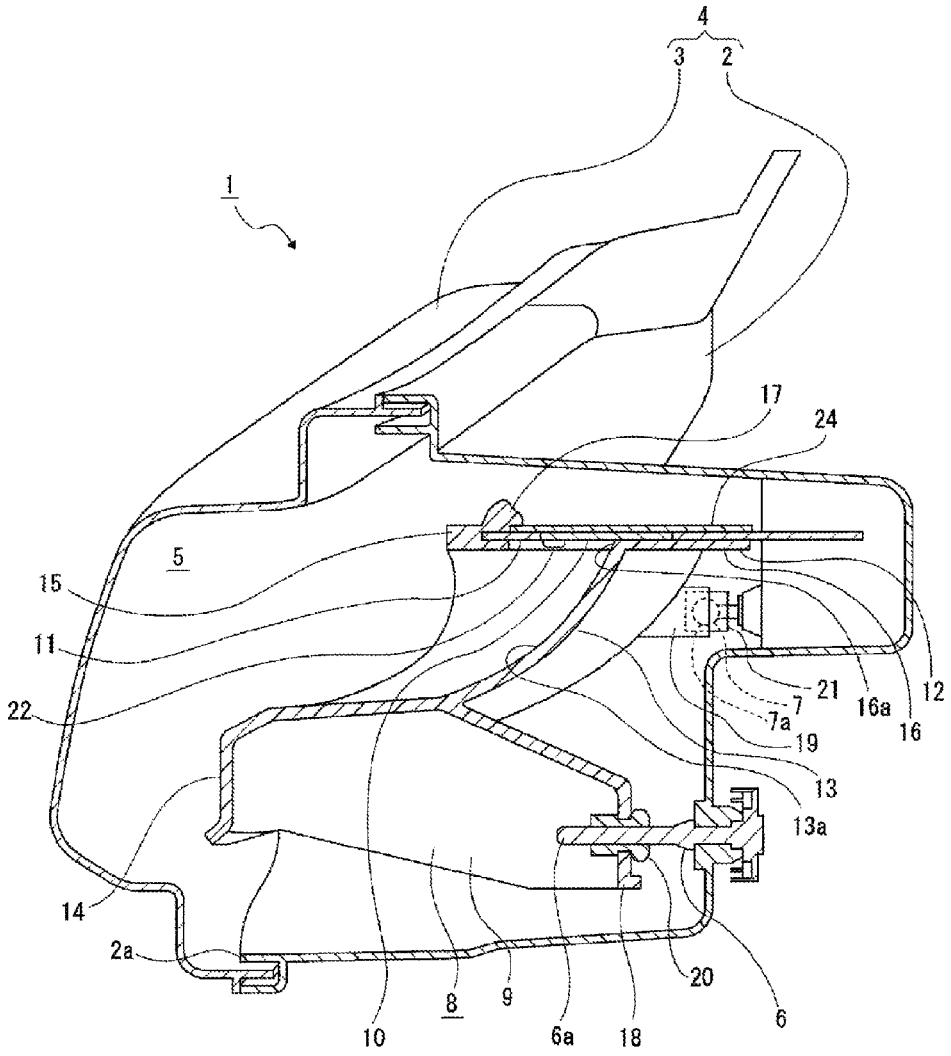
FIG. 1 is a cross-sectional view illustrating a vehicular lamp according to an embodiment of the present disclosure.
Figure 2:
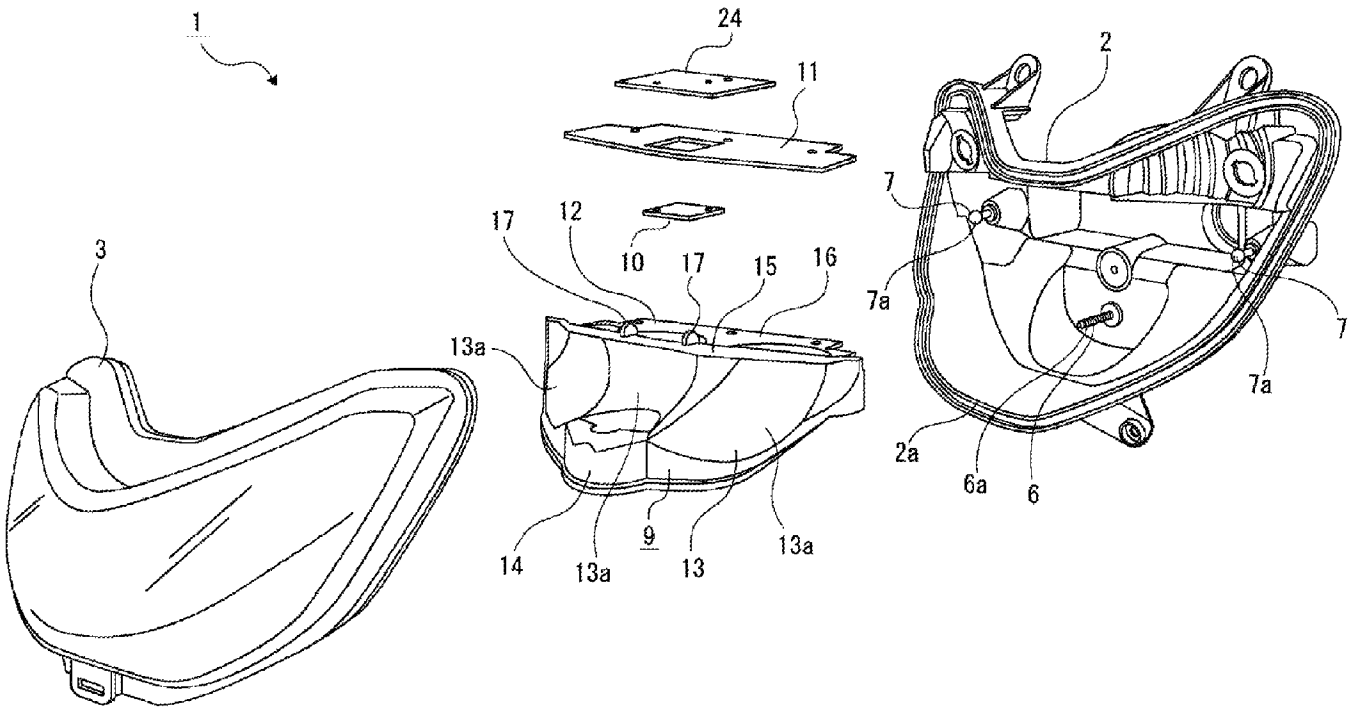
FIG. 2 is an exploded perspective view illustrating the vehicular lamp.

A vehicular lamp 1 is, for example, a vehicular headlamp. As illustrated in FIGS. 1 and 2, the vehicular lamp 1 includes a lamp housing 2 with a recess opened on the front side thereof, and a cover 3 arranged to close the opening 2*a* of the lamp housing 2. A lamp outer case 4 is constituted with the lamp housing 2 and the cover 3, and an inner space of the lamp outer case 4 is formed as a lamp chamber 5.

On the rear surface of the lamp housing 2, an aiming screw 6 is rotatably supported at a position below a central portion in the left-right direction. The aiming screw 6 has a screw shaft portion 6*a* provided on a substantially front half portion thereof, and is installed in such a way that the aiming screw is unmovable in relation to the lamp housing 2 in the front-back direction.

Pivot shafts 7 are attached to the rear surface of the lamp housing 2 to be spaced apart from each other in the left-right direction at the upper side of the aiming screw 6. The front end of each of the pivot shafts 7 is formed as a spherical portion 7*a*.

A lamp unit 8 is disposed in the lamp chamber 5. The lamp unit 8 has a reflector 9, a first board 10, and a second board 11. The first board 10 and the second board 11 have different heat dissipation performances from each other. For example, the heat dissipation performance of the first board 10 is higher than that of the second board 11. The lamp chamber 5 is also provided with an extension (not illustrated) that shields a portion of the lamp unit 8.

The reflector 9 is an optical member functioning to reflect light, and includes a base surface portion 12 facing in an up-down direction, a control surface portion 13 formed in a gently-curved shape to protrude substantially obliquely downward and forward from a rear edge of the base surface 12, and an outer edge portion 14 provided continuously to the peripheral edge of the control surface portion 13 below the base surface portion 12.

Figure 3:
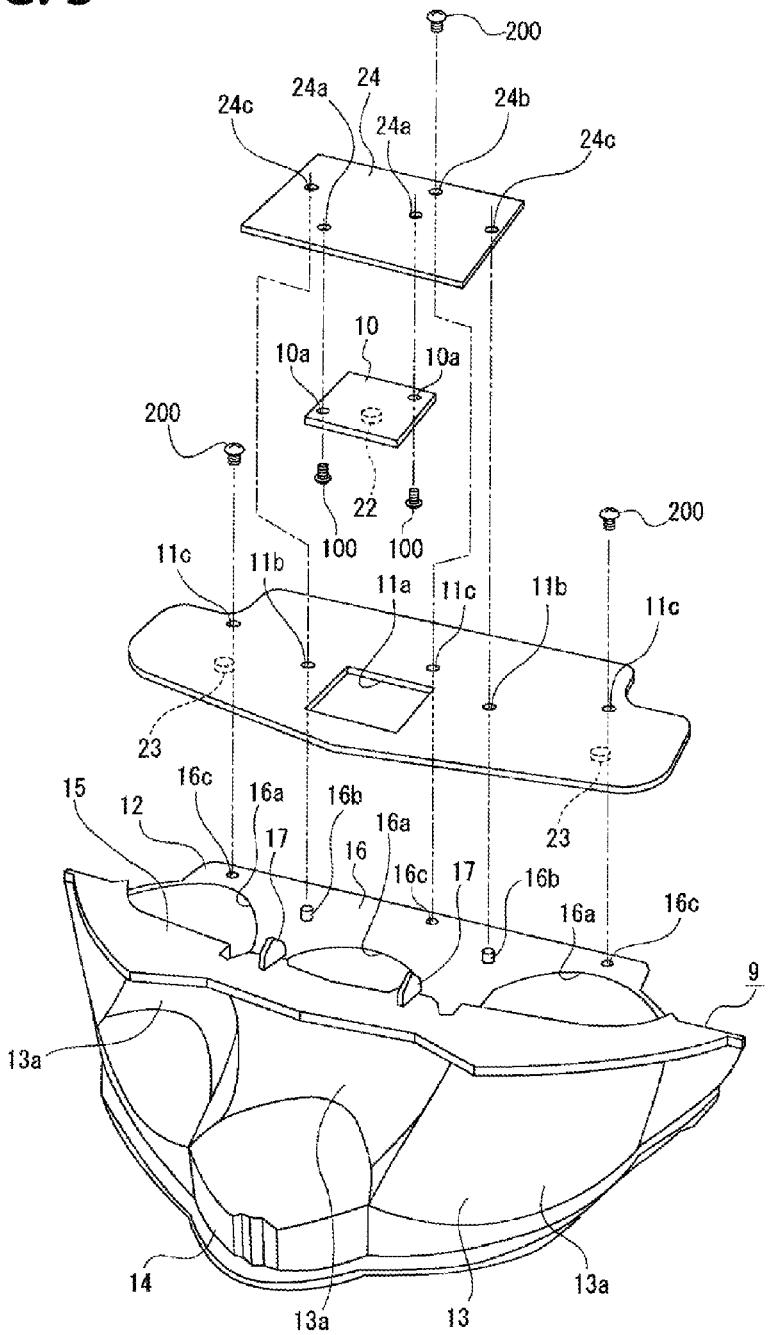
FIG. 3 is an exploded perspective view illustrating a reflector, a board, and a heat sink.

The base surface 12 has a front end portion 15 that is formed to be higher than other portion thereof, which serves as a board mounting portion 16 (see, e.g., FIG. 3). In the board mounting portion 16, penetration holes 16*a* are formed to be spaced apart from each other in the left-right direction. In the board mounting portion 16, positioning pins 16*b* protruding upward are provided to be spaced apart from each other in the left-right direction. Also, in the board mounting portion 16, screw holes 16*c* are formed to be spaced apart from each other in the left-right direction.

In the control surface portion 13, reflective portions 13*a* are provided successively in the lateral direction, and the upper edges of the reflective portions 13*a* are aligned with the opening edges of the penetration holes 16*a*, respectively.

Figure 4:
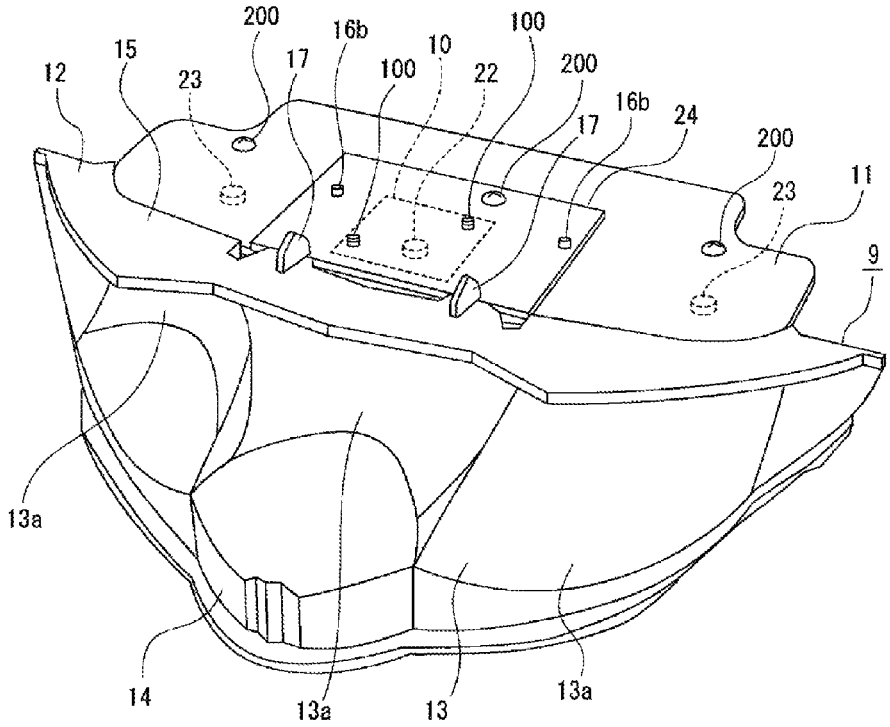
FIG. 4 is a perspective view illustrating the reflector, the board, and the heat sink.

As illustrated in FIGS. 3 and 4, in the reflector 9, pushing protrusions 17 protruding rearward from the rear edge of the top surface of the front end portion 15 are provided to be spaced apart from each other in the left-right direction, and a portion of each pushing protrusion 17 is positioned above the board mounting portion 16.

The reflector 9 is provided with a nut mounting portion 18 protruding rearward from a lower end thereof (see, e.g., FIG. 1). The nut mounting portion 18 is located at the central portion in the left-right direction. Also, at a position in the vicinity of the upper end of the reflector 9, pivot fastening portions 19 protruding rearward are provided to be spaced apart from each other in the left-right direction.

A nut member 20 is mounted in the rear end of each of the nut mounting portions 18. Pivot holders 21 are mounted on the pivot mounting portions 19, respectively.

When the screw shaft portion of the aiming screw 6 is threaded to the nut member 20 and the spherical portions 71 of the pivot shafts 7 are connected to the pivot holders 21, respectively, the reflector 9 may be supported to be tilted in the up-down direction using each of the spherical portions 7*a* as a fulcrum.

The first board 10 is a metallic circuit board made of, for example, copper or aluminum, and a first light source package 22 having, for example, two (2) semiconductor light emitting elements, is mounted on the bottom surface of the first board 10 (see, e.g., FIGS. 1 and 3). The first board 10 is formed with screw insertion holes 10*a* (see, e.g., FIG. 3).

The second board 11 is a circuit board made of a resin (e.g., frame retardant type 4 (RF-4), and has an appearance larger than that of the first board 10. An alignment opening 11*a* having substantially the same size as the first board 10 is formed in the central portion of the second board 11 in the left-right direction. Second light source packages 23 each having, for example, one (1) semiconductor light emitting element are mounted on the bottom surface of the second board 11 at the left and right sides with the alignment opening 11*a* being interposed therebetween. The second board 11 includes positioning holes 11*b* which are formed to be spaced apart from each other in the left-right direction. The second board includes insertion holes 11*c* which are formed to be spaced apart from each other in the left-right directions.

The first light source package 22 and one of the second light source packages 23 serve as light source packages for both low and high beams, for example, while the other of the second light source packages 23 serves as a dedicated light source package for a high beam, for example.

The first board 10 is inserted into and arranged in the alignment opening 11*a* of the second board 11. The first board 10 is mounted on the bottom surface of a heat sink 24. For example, the heat sink 24 is formed in a plate shape that has a size larger than that of the first board 10, and faces in the up-down direction. The heat sink 24 is made of a material having a high heat dissipation performance (e.g., a metal). The heat sink 24 includes threaded holes 24*a* and a screw hole 24*b* formed therein. The heat sink 24 includes positioning pin insertion holes 24*c* which are formed to be spaced apart from each other in the left-right direction.

Figure 5:
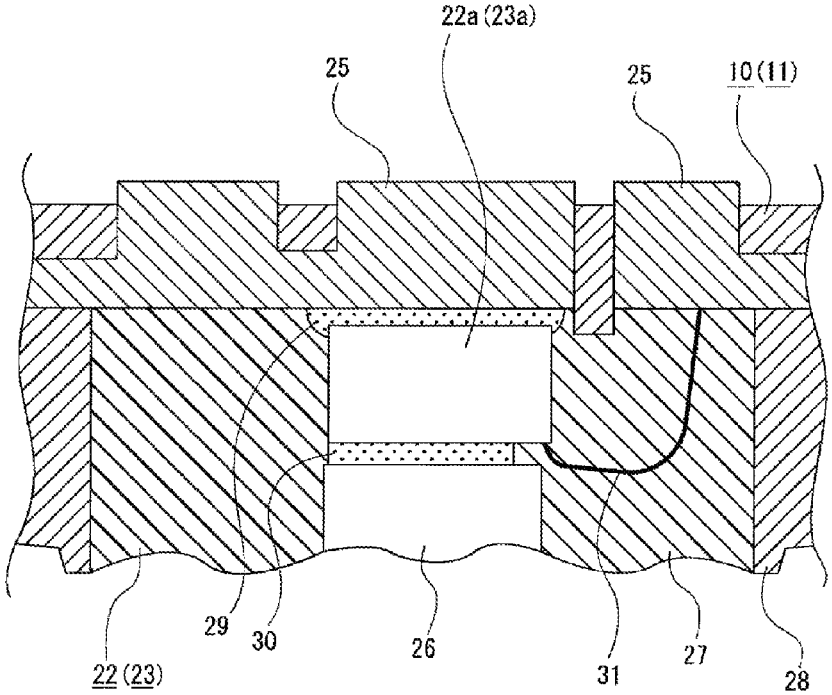
FIG. 5 is an enlarged cross-sectional view illustrating a light source package.

The first light source package 22 and the second light source packages 23 are respectively bonded to and mounted on lead frames 25, which are formed on the first board 10 and the second board 11, respectively (see, e.g., FIG. 5). Each of the first light source package 22 and the second light source packages 23 includes one or more semiconductor light emitting elements 22*a* (23*a*), a phosphor 26, and a sealing resin 27. An annular body 28 is disposed on the bottom surfaces of the lead frames 25, and the semiconductor light emitting element 22*a* (23*a*) is disposed inside the annular body 28 in a state in which the semiconductor light emitting element 22*a* (23*a*) is bonded to one of the lead frames 25 by a bonding material, such as a solder. The phosphor 26 is adhered to bottom surface of the semiconductor light emitting element 22*a* (23*a*) by an adhesive 30, and the semiconductor light emitting element 22*a* (23*a*) is connected to the other of the lead frames 25 by a metal wire 31. The semiconductor light emitting element 22*a* (23*a*) is sealed by the sealing resin 27 enclosed in the body 28.

The first board 10 is mounted from the bottom side of the heat sink 24 when screw members 100 are respectively inserted into the screw insertion holes 10*a* to be threaded to the threaded holes 24*a* (see, e.g., FIGS. 3 and 4).

When the positioning pins provided on the board mounting portion 16 of the reflector 9 are respectively inserted into the positioning holes 11*b* and the positioning pin insertion holes 24*c* from the bottom side, the second board 11 and the heat sink 24 are positioned in relation to the board mounting portion 16.

In the state in which the second board 11 is positioned in relation to the board mounting portion 16, mounting screws 200, which are respectively inserted into the left and right insertion holes 11*c*, are threaded to the screw holes 16*c*, respectively, so that the second board 11 is mounted on the board mounting portion 16 from the upper side.

In the state in which the first board 10 is mounted on the heat sink 24 such that the heat sink is positioned in relation to the board mounting portion 16, the mounting screw 200 inserted into the screw hole 24*b* and the insertion hole 11*c* positioned at the center is threaded to the screw hole 16*c*. Thus, the heat sink 24 and the second substrate 11 are co-fastened and mounted on the board mounting portion 16 from the upper side.

Since the second board 11 and the heat sink 24 are mounted on the reflector 9 by the co-fastening, it is not necessary to separately mount the second board 11 and the heat sink 24 on different members, thereby improving workability in the mounting work.

The heat sink 24 is also mounted on the second board 11 by the co-fastening. As described above, the heat sink 24 is mounted on the second board 11, and the first board 10 is mounted on the heat sink 24. Thus, the first board 10 is mounted on the second board 11 with the heat sink 24 being interposed therebetween, and as a result, a coupling structure between for the first structure 10 and the second structure 11 is not required, which may simplify the configuration.

In addition, since the alignment opening 11*a* is formed in the second board 11 and the first board 10 is arranged within the alignment opening 11*a*, the first board 10 is arranged inside the second board 11 so that the whole size of the first board 10 and the second board 11 is decreased, thereby downsizing the vehicular lamp 1.

In the state in which the heat sink 24 is mounted on the board mounting portion 16, the entire top surface of the first board 10 is in contact with the bottom surface of the heat sink 24, and the outer peripheral portion of the bottom surface of the heat sink 24 is in contact with a portion of the top surface of the second board 11.

In the state in which the first board 10 and the second board 11 are mounted on the board mounting portion 16, the first light source package 22 mounted on the first board 10 and the second light source packages 23 mounted on the second board 11 are respectively positioned above the penetration holes 16*a*.

Figure 6:
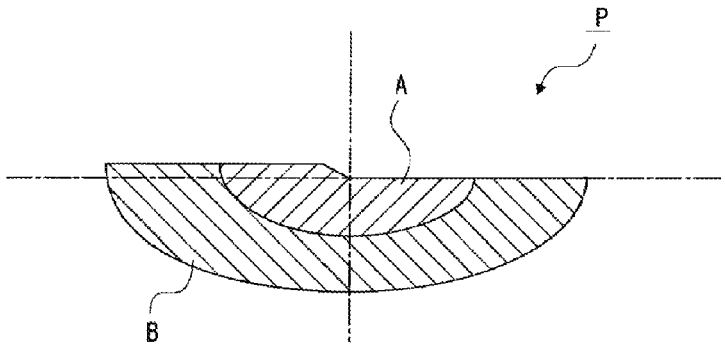
FIG. 6 is a view illustrating a light distribution pattern of a low beam.

When a current is supplied to the first light source package 22 and one of the second light source packages 23, light is emitted from each of the first light source package 22 and the second light source package 23, and the emitted light passes through the penetration holes 16*a* of the reflector 9 and then is reflected by the reflective portions 13*a* so that the light is irradiated forward through the cover 3 as the low beam. In this instance, as illustrated in FIG. 6, the light emitted from the first light source package 22 forms a region A the central portion in a light distribution pattern P, while the light emitted from the second light source package 23 forms a region B in the peripheral portion around the region A in the light distribution pattern P.

Figure 7:
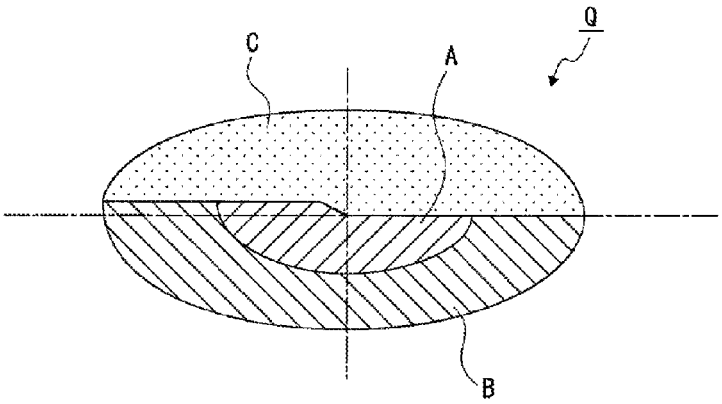
FIG. 7 is a view illustrating a light distribution pattern of a high beam.

When a current is supplied to the first light source package 22 and the second light source packages 23, light is emitted from each of the first light source package 22 and the second light source packages 23, and the emitted light passes through the penetration holes 16*a* of the reflector 9 and then is reflected by the reflective portions 13*a* so that the light is irradiated forward through the cover 3 in as the high beam. In this instance, as illustrated in FIG. 7, the light emitted from the first light source package 22 forms a region A in the center in a light distribution pattern Q, the light emitted from one of the second light source packages 23 forms a region B in the peripheral portion around the region A in the light distribution pattern Q, while the light emitted from the other second light source package 23 forms a region C which is a substantially upper half portion in the light distribution pattern Q.

In the vehicular lamp 1, when the aiming screw 6 is turned, the nut member 20 is moved back and forth, and the pivot holders 21 are respectively pivoted in relation to the pivot shafts 7 using each of the spherical portions 7*a* as a fulcrum, and the reflector 9 is tilted upward or downward in relation to the lamp housing 2. As the reflector 9 is tilted upward or downwardly, the aiming adjustment is carried out to adjust an optical axis with respect to the first light source package 22 and the second light source packages 23.

Figure 8:
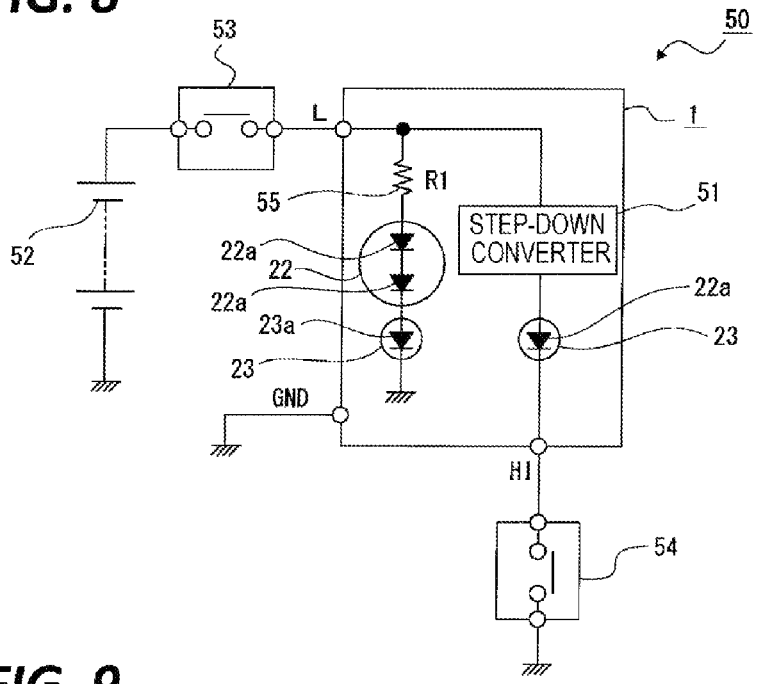
FIG. 8 is a circuit diagram illustrating one example of a lighting circuit.

Now, one example of a lighting circuit configured to emit light from the first light source package 22 and the second light source packages 23 will be described (see, e.g., FIG. 8).

A lightning circuit 50 includes a step-down converter 51, and the first light source package 22 is connected in series to one of the second light source packages 23. A control of electric power supplied from a power source 52 is carried out by an ON/OFF combination of a lightning switch 53 and a changeover switch 54, and an ON/OFF switching between the first light source package 22 and the second light source packages 23 is performed by the ON/OFF combination.

Light is emitted from the first light source package 22 and one of the second light source packages 23 which are the light source packages for both low and high beams, both when irradiating the high beam and when irradiating the low beam. The other of the second light source packages 23 which a dedicated package for the high beam is turned on by a constant current from the step-down converter 51, and from the other second light source package 23, light is emitted only when lighting the high beam.

A resistor 55 is incorporated in a first closed circuit which is connected in series to the first light source package 22 and the one second light source package 23, and a resistance control is carried out in the first closed circuit. Meanwhile, a constant current control is carried out in a second closed circuit having the other second light source package 23.

As described above, the first light source package 22 has two semiconductor light emitting elements 22*a*, and each of the second light source packages 23 has one semiconductor light emitting element 23*a*. Thus, the first light source package 22 is turned on by an electric power higher than that required for turning on the second light source packages 23.

The lighting circuit 50 is controlled to emit the light of the high beam using the step-down converter 51. Thus, the lighting circuit may suppress the calorific value generated at the time of lighting, and may be manufactured at a low cost.

Figure 9:
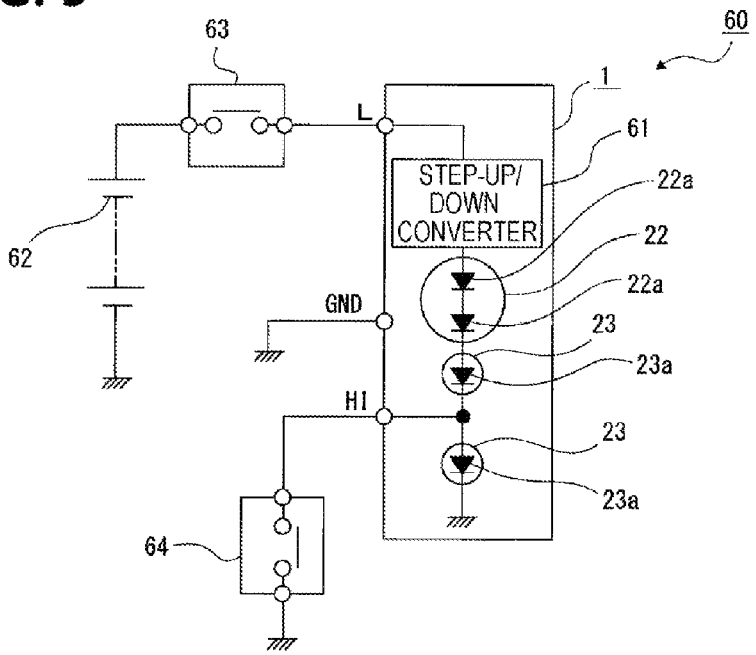
FIG. 9 is a circuit diagram illustrating another example of the lighting circuit.

Alternatively, in the vehicular lamp 1, a lightning circuit 60 may be used instead of the lightning circuit 50 (see, e.g., FIG. 9).

The lightning circuit 60 includes a step-up/down converter 61, and the first light source package 22, one second light source package 23, and the other second light source package 23 are connected in series to each other. A control of electric power supplied from a power source 62 is carried out by an ON/OFF combination of a lightning switch 63 and a changeover switch 64, and an ON/OFF switching between the first light source package 22 and the second light source packages 23 is performed by the ON/OFF combination.

In performing the switching between the low beam and the high beam, the step-up/down converter 61 is operated and a step-up control and a step-down control are carried out. Light is emitted from the first light source package 22 and one of the second light source packages 23 which are the light source packages for both the low and high beams both when irradiating the high beam and when irradiating the low beam. From the other second light source package 23 which is a dedicated package for the high beam, light is emitted only when irradiating the high beam.

As described above, the first light source package 22 has two semiconductor light emitting elements 22*a*, and each of the second light source packages 23 has one semiconductor light emitting element 23*a*. Thus, the first light source package 22 is turned on by an electric power that is higher than that required for turning on each of the second light source packages 23.

The lightning circuit 60 is controlled to emit the light of the high beam using the step-up/down converter 61. Thus, the lighting circuit 60 may to suppress the calorific value generated at the time of lightning.

As described above, in the vehicular lamp 1, the first board 10 and the second board 11 are different kinds of boards that have different heat dissipation performances.

Since the dissipation for the heat generated when the first light source package 22 is driven is different from the dissipation for the heat generated when the second light source packages 23 are driven, a good heat dissipation performance control may be performed depending on an irradiation state (e.g., the irradiation state of the high beam and the irradiation state of the low beam).

In particular, the first board 10 mounted with the first light source package 22 has a heat dissipation performance higher than that of the second board 11 with the second source modules 22 mounted thereon. Thus, even though the amount of the heat generated from the first light source package 22 is increased, a high heat dissipation performance may be secured when the first light source package 22 is driven, and the luminous intensity of the low beam may be enhanced after the stable drive of the first light source package 22 is secured.

Also, since the first light source package 22 is turned on by an electric power higher than that required for turning on the second light source package 23, and the first board 10 has a heat dissipation performance higher than that of the second board 11, the heat dissipation performance for the heat generated when the first light source package 22 is driven is higher than the heat dissipation performance for the heat generated when the second light source packages 23 are driven. Thus, a stable driving state of the first light source package 22 may be secured.

In addition, since the first board 10 is made of a metal and the second board 11 is made of a resin, the heat dissipation performance for the heat generated when the first light source package 22 is driven is higher than the heat dissipation performance for the heat generated when the second light source packages 23 are driven. Thus, a stable driving state of the first light source package 22 may be secured with a simple configuration.

Furthermore, since the heat sink 24 is provided to release the heat conducted from the first board 10, the heat generated when the first light source package 22 is driven is released by the heat sink 24 such that the heat-dissipation performance from the first board at the time of driving the first light source package 22 may be enhanced, and a stable drive state of the first light source package 22 may be secured with a simple configuration.

Furthermore, since the heat sink 24 is disposed in a state of being in contact with a portion of the top surface of the second board 11, as well as in a state of being in contact with the entire top surface of the first board 10, a part of the heat generated when the second light source packages 23 are driven is also transferred to the heat sink 24 to be released from the heat sink 24.

Accordingly, a high heat dissipation performance for the heat generated when the first light source package 22 is driven and the heat generated when the second light source packages 23 are driven may be secured, and a stable drive state of the first light source package 22 and the second light source packages 23 may be secured.

Further, the second light source packages 23 are arranged to be apart from each other in the left-right direction, the first light source package 22 serves as the low beam, and the first light source package 22 for the low beam which is highly used is turned on by the high electric power. Therefore, the luminous intensity of the low beam may be enhanced after a desired heat dissipation performance is ensured.

Furthermore, since the first light source package 22 is provided with two semiconductor light emitting elements 22*a* and the second light source package 23 is provided with one semiconductor light emitting element 23*a*, the luminous flux generated from the first light source package 22 is increased, thereby enhancing the luminous intensity after a high heat dissipation performance is ensured.

Descriptions have been made above concerning an example in which the first light source package 22 is provided with two semiconductor light emitting elements 22*a* and the second light source packages 23 are respectively provided with the semiconductor light emitting elements 23*a*. However, it will be understood that the vehicular lamp 1 may be configured such that each of the first light source package 22 and the second light source packages 23 is provided with one semiconductor light emitting element 22 or 23*a*.

In this case, the first light source package 22 serves as a dedicated light source package for the high beam, while the second light source packages 23 serve as the light source packages for both low and high beams.

When the first light source package 22 is used for the high beam, the first board 10 with the first light source package 22 for the high beam mounted thereon has a heat dissipation performance higher than that of the second board 11.

In general, a semiconductor light emitting element has a characteristic that when its temperature is raised, the luminous flux is hardly increased. Therefore, when the first light source package 22 is mounted on the first board 10 having a high heat dissipation performance, the luminous flux may be increased and the enhancement of the luminous intensity of the high beam may be achieved with a small number of semiconductor light emitting elements.

In addition, descriptions have been made above concerning an example in which the first board 10 is formed of a metal, and the second board 11 is formed of a resin so that the first board 10 and the second board 11 exhibit different heat dissipation performances. Different kinds of boards may include, for example, boards that are respectively formed of materials having different thermal resistances such that the heat dissipation performances of the boards are different from each other, and boards that have different heat dissipation areas according to the shapes or sizes thereof such that the heat dissipation performances of the boards are different from each other.

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims.

What is claimed is:

1. A vehicular lamp comprising:

a lamp outer case including a lamp housing having an opening and a cover configured to close the opening;

a first board configured to mount a first light source package on a lower surface thereof;

a second board configured to mount a second light source package on a lower surface thereof and of which an alignment opening having substantially the same size as the first board is formed in a central portion in a left-right direction, such that the first board is inserted into and arranged in the alignment opening of the second board;

an optical member configured to mount the first board and the second board on an upper surface thereof; and a heat sink configured to release heat conducted from the first board and the second board, wherein the first board and the second board are different kinds of boards that have different heat dissipation performances, and the second board and the heat sink are mounted on the optical member by co-fastening such that an entire top surface of the first board becomes in contact with a bottom surface of the heat sink, and an outer peripheral portion of the bottom surface of the heat sink becomes in contact with a portion of a top surface of the second board.

2. The vehicular lamp of claim 1, wherein the first light source package is turned on by an electric power higher than that required for turning on the second light source package, and the first board has a heat dissipation performance higher than that of the second board.

3. The vehicular lamp of claim 1, wherein the first board has a heat dissipation performance higher than that of the second board, two second light source packages are arranged to be spaced apart from each other in a left-right direction, and the first light source package is configured to be used for a high beam.

4. The vehicular lamp of claim 2, wherein the first board is a metallic board, and the second board is a resin board.

5. The vehicular lamp of claim 2, wherein two second light source packages are arranged to be spaced apart from each other in a left-right direction, and the first light source package is configured to be used for a low beam.

6. The vehicular lamp of claim 2, wherein the first light source package is provided with two semiconductor light emitting elements, and the second light source package is provided with one semiconductor light emitting element.

7. The vehicular lamp of claim 3, further comprising:

a lighting circuit including a first closed circuit in which the first light source package is connected in series to one of the two second light source packages, and a second closed circuit in which a step-down converter and the other of the two second light source packages are provided, wherein the first closed circuit includes a resistor and a resistance control is carried out in the first closed circuit, and a constant current control is carried out in the second closed circuit.

8. The vehicular lamp of claim 7, wherein a lighting circuit includes a step-up/down converter, and the first light source package, one of the two second light source packages, and the other of the two second light source packages are connected in series to each other.

* * * * *